United States Patent [19]

Smith et al.

[11] Patent Number: 4,861,191

[45] Date of Patent: Aug. 29, 1989

[54] ROAD WIDENER

[75] Inventors: Donald W. Smith, Aurora; James J. Plociennik, North Aurora, both of Ill.

[73] Assignee: Barber-Greene Company, DeKalb, Ill.

[21] Appl. No.: 206,312

[22] Filed: Jun. 14, 1988

[51] Int. Cl.[4] ..... E01C 19/48

[52] U.S. Cl. ..... 404/104; 404/101

[58] Field of Search ..... 404/104, 105, 108, 101

[56] References Cited

U.S. PATENT DOCUMENTS

| | | | |
|---|---|---|---|
| 3,130,654 | 4/1964 | Apel et al. | 404/104 |
| 3,131,616 | 5/1964 | Gostovich | 404/104 |
| 3,177,785 | 4/1965 | MacDonald | 404/104 |
| 3,442,189 | 5/1969 | Robinson et al. | 404/105 |
| 3,466,989 | 9/1969 | Ulrich et al. | 404/104 |
| 3,636,831 | 1/1972 | Davin et al. | 404/104 X |

FOREIGN PATENT DOCUMENTS

| | | | |
|---|---|---|---|
| 2346897 | 4/1975 | Fed. Rep. of Germany | 404/104 |

*Primary Examiner*—Jerome W. Massie
*Assistant Examiner*—Matthew Smith
*Attorney, Agent, or Firm*—Jones, Day, Reavis & Pogue

[57] ABSTRACT

An improved road widener capable of quick and easy conversion from widening the road on the right side of the device to widening the road on the left side. The road widener's chassis contains recesses on both sides which extend within the tread width of the wheels and which can receive the strike-off tool and a post supporting the strike-off tool. A conveyor for dispensing asphalt material is mounted on rollers such that it can shift from a position extending from one side of the chassis to a position on the other side. The conveyor has two motors such that it can be easily changed from conveying in one direction to the opposite direction. The side of the device being paved can be quickly, simply and easily changed by retracting the strike-off tool and support post into the recess on one side, extending the strike-off tool and support post on the other side, shifting the conveyor from extending from one side to extending to the other side, and reversing the direction of drive motors.

15 Claims, 3 Drawing Sheets

ROAD WIDENER

BACKGROUND OF THE INVENTION

The invention generally relates to road making machines. In particular, the invention pertains to machines that can widen the side of a previously paved or graded surface while riding on that surface.

In the past, road wideners have been wheeled vehicles which deposit paving material, usually asphaltic pavement material (hot or cold mix), along the side of the vehicle. The vehicle pulls along a strike-off tool protruding from its side for evenly spreading the paving material along the side of the surface upon which the vehicle rides. Paving material is contained in a hopper in the front of the device and is replenished by a dump truck or other vehicle for carrying the mix from the asphalt plant. A conveyor in the front of the device below the hopper controllably deposits paving material along the side of the machine and the strike-off tool evenly spreads the paving material on the side of the road.

Recently, Blaw-Knox Construction Equipment Company of Mattoon, Ill. developed a road widener designated "RW-195C" which is controlled by an operator sitting on top of the machine. The device has a hopper on its front and conveyor located below the hopper to deposit material from the hopper to the side of the widener. A strike-off connected to the side of the machine is drawn over the deposited material to produce a layer having controlled width, depth and slope. The conveyor is driven by an independent variable speed hydrostatic drive system and can be extended and retracted hydraulically up to 11 inches.

The pivotally connected strike-off tool on the Blaw-Knox machine can be swung flush with the side of the machine to limit total machine width to 11 feet, 11 inches. A support which is pivotally attached to the machine at a point outside of the gauge width is attached to support the strike-off against the pressure of the paving material against the strike-off as the road widener proceeds forward.

Road wideners of the type described are capable of paving on either the right or the left side of the machine. However, the Blaw-Knox RW-195C road widener and other road wideners known in the prior art are not easily converted from being capable of widening the shoulder on one side of the machine to being capable of widening the other side of the machine. The Blaw-Knox specifications describe the cumbersome steps which must be undertaken in order to accomplish this: "To reverse conveyor discharge, simply transfer conveyor drive transmission, strike-off assembly and control console to the opposite side of the machine and reposition conveyor shuttle cylinder." Although the specifications characterize the method as being accomplished "simply", such a procedure is actually quite time-consuming.

Road paving jobs commonly require that both the left shoulder and the right shoulder of a highway be paved. It is required by state regulation (in some instances) or by common safety practices to pave the shoulder while moving in the direction of the traffic. Accordingly, in order to pave the right and left shoulders of a divided highway having traffic, it will be necessary to pave on both sides of the road with traffic going the same direction.

It is an object of the present invention to provide a road widener which can be easily and quickly converted from widening the road on one side of the device to widening the road on the opposite side of the device.

It is another object of the present invention to provide an improved widener which allows quick and easy conversion of paving operations to the opposite side of the roadway while continuing to go in the same direction.

It is yet another object of the present invention to provide a machine which allows changing the side of paving without detachment and remounting of a strike-off tool.

It is a further object of the present invention to provide a machine which can reverse direction and still pave the same side of the road without having to remount a strike-off tool, to transfer the conveyor drive transmission, or undertake any significant manual mechanical modifications.

It is yet another object of the present invention to provide a road widener having conveyor which easily and quickly can reverse directions or discharge.

It is yet a further object of the present invention to provide a road widener having strike-off tool systems on both sides which can fold into a recess of the chassis substantially within the tread or gauge width of the wheels and not significantly increase the width of the road widener during transport.

Other and further objects will become apparent from the following discussion of the invention and its embodiments.

SUMMARY OF THE INVENTION

The present invention avoids the above-mentioned problems and accomplishes the objectives set forth by utilizing a chassis having a recessed area on each side which extends within the tread width of the wheels, and by having strike-off tool systems mounted on both sides of the chassis such that they can be swung easily into the recessed areas and not add substantial width to the chassis during transport. The tool system comprises a telescopic, extendable support post pivotally mounted in the recess on each side within the tread width which supports the strike-off tool against the pressure of the paving material on the road as the machine moves forward. Each strike-off tool also is pivotally mounted to the chassis such that it can swing against the machine and out of the way during transport. For longer strike-off tools, the tool is pivotally hinged along its length such that it can fold back upon itself, or is hydraulically retractable, such that it can pivot into the recess.

The chassis supports a hopper at its front which holds and deposits paving material onto a conveyor capable of discharging the paving material to either side of the chassis. Both motors drive the conveyor, although the head pulley motor provides the primary driving force. Both motors drive the conveyor in one or the other direction. It is not necessary to remove and remount or otherwise physically modify the conveyor drive train in order to reverse the direction of the conveyor. Further, the conveyor is mounted on rollers which allows easy and quick sliding to shift it between the desired positions.

The road widener is easily converted from being used to widen the road on one side of the device to widening the other side by collapsing the support post into itself and pivoting it flush against the chassis. The strike-off tool is swung into the recess and hinged pivotally or hydraulically retracted along its length so that it can be pivoted to fit almost entirely within the recess. The conveyor system is then shifted from extending from one side of the machine to extending from the other side of the machine by operation of a hydraulic cylinder located beneath the conveyor. The drive motors are both reversed in direction of drive by a switch on the control station 28 activated by the operator which then drive the conveyor to discharge in the opposite direction.

The strike-off tool on the side now to be widened is put into operating position by swinging the strike-off tool about its pivot and extending the tool to its entire length (either by unfolding or hydraulic extension) and securing it. The support post is swung about its pivotal connection to the chassis and extended to the desired length, and thereafter attached to the strike-off tool to secure it in position.

It is seen that the contemplated road widener of the invention can easily, simply and quickly be converted from being capable of widening the road on one side of the machine to widening the road on the other side.

DETAILED DESCRIPTION OF THE INVENTION

Figure 1:
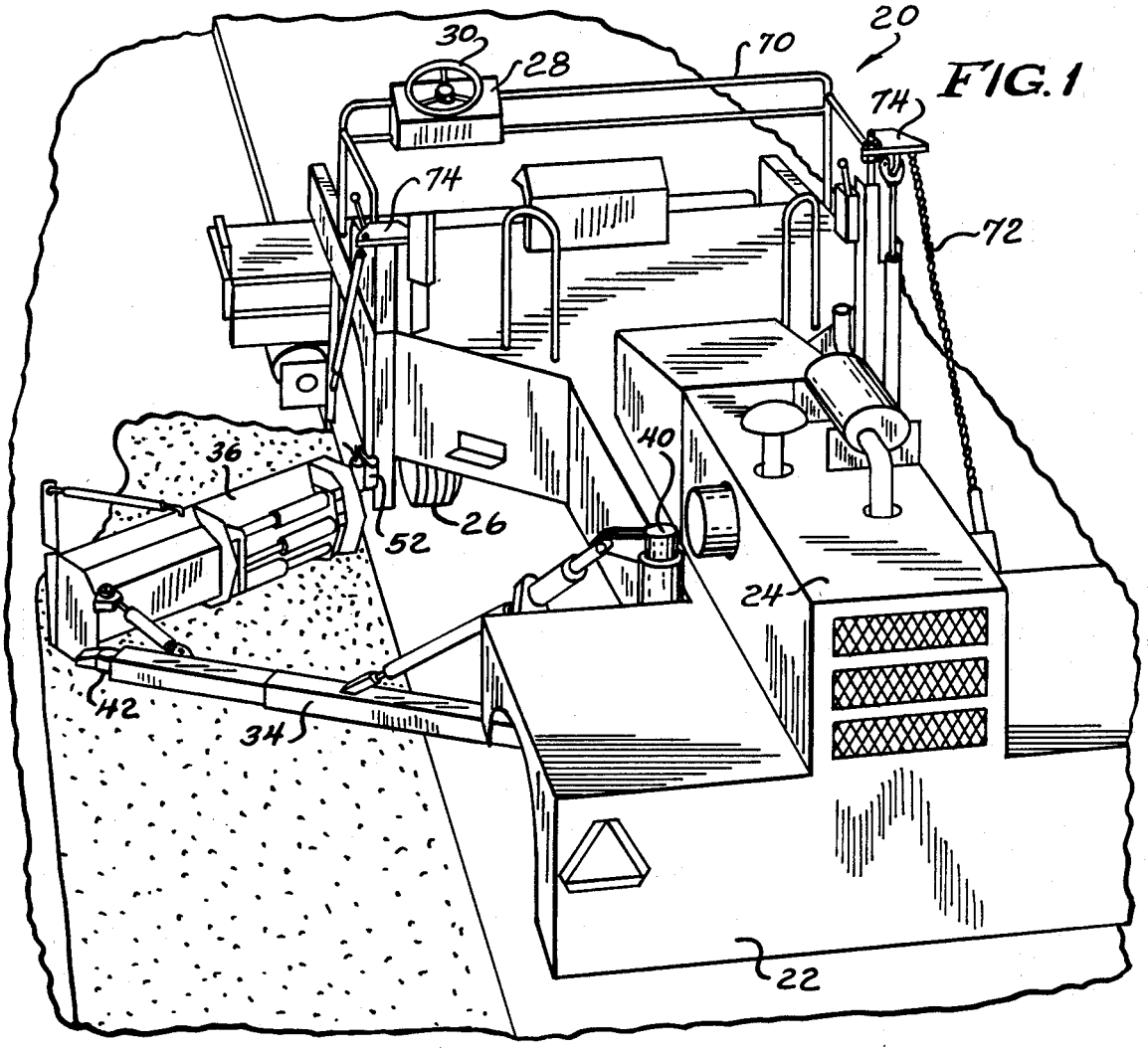
FIG. 1 is a rear perspective view of the road widener of the present invention.
Figure 3:
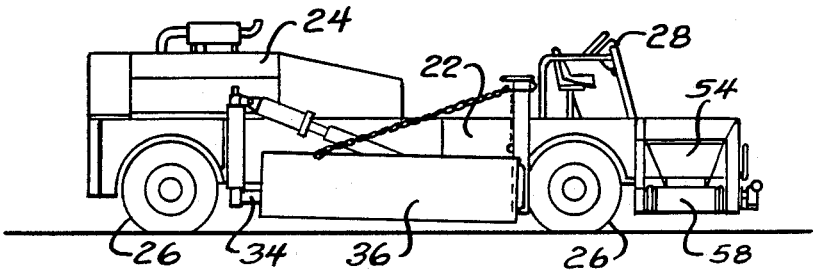
FIG. 3 is a side planar view of the present invention.
Figure 2:
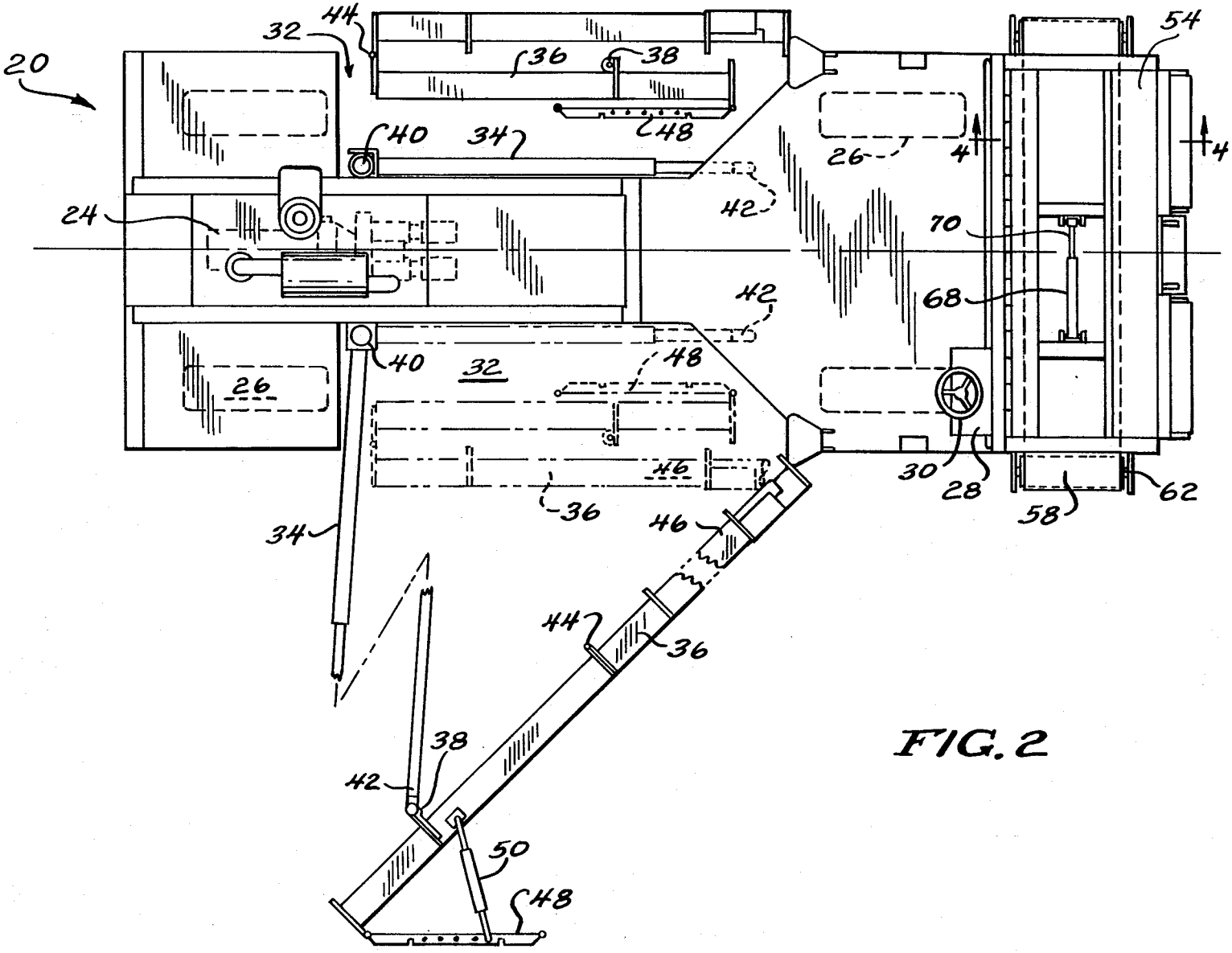
FIG. 2 is a top planar view of the road widener of the present invention partially in phantom to show folding of the strike-off tool systems into the recesses.
Figure 4:
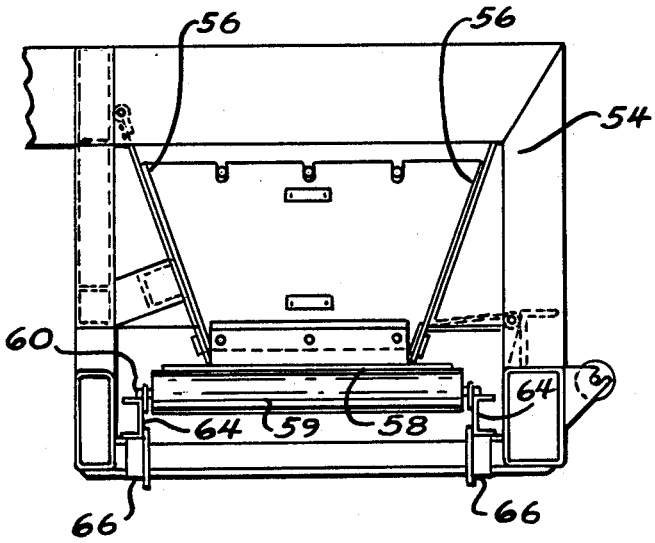
FIG. 4 is a detailed right side view of the conveyor system along the view indicated 4—4 in FIG. 2.
Figure 5:
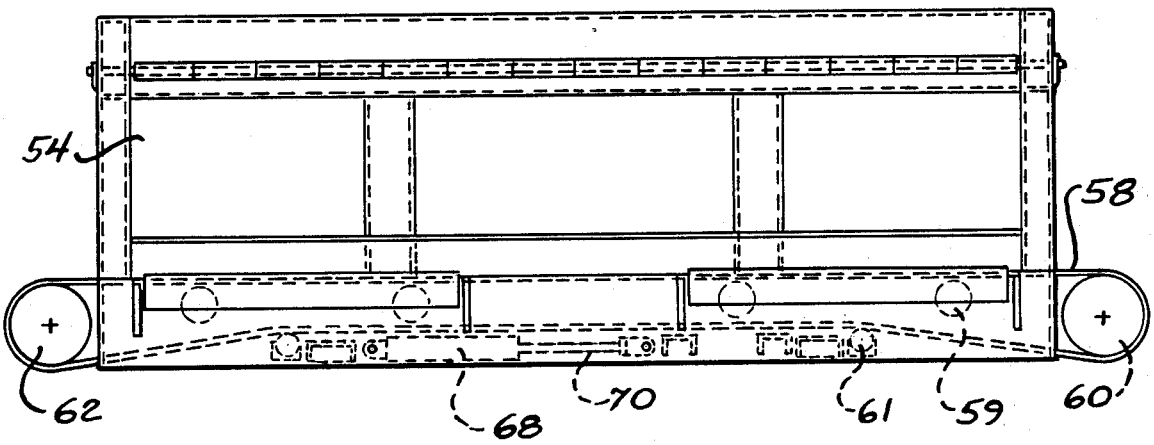
FIG. 5 is a front detailed view of the conveyor system as seen along line 5—5 in FIG. 2.

The road widener contemplated by the present invention is better understood with reference to the above-described drawings. Referring to FIGS. 1-3, the road widener is generally designated by the numeral 20. The road widener is comprised of a chassis 22 which has a power plant 24 which operates through a standard drive mechanism to provide torque to wheels 26. A moveable control station 28 has controls and steering wheel 30 for operation of the road widener by a human operator (not shown).

The chassis is supported on two axels and four wheels 26. The front and rear wheels are set apart by a "tread width" or otherwise called "gauge width" which are preferably about seven feet but may be larger or smaller depending on the application or other design modification. The chassis 22 contains a recessed area 32 on both sides. The recessed area comes substantially into the side-to-side width of the widener which is preferably about 12 feet wide. The recessed areas come substantially within the tread width of the chassis and provide areas for storing the strike-off tool systems as will be described below.

Referring specifically to FIG. 2, the road widener is shown with right tool system extended and left tool system retracted, as it would normally be oriented when paving a road surface on the right of the chassis. The right strike-off tool 36 is hinged approximately half way along its length such that it can swing back upon itself and into the recess 32, as is shown in phantom lines. Telescopic support post 34 attaches at its distal end to a connector 38 on the strike-off tool 36. The telescopic support post can be telescopically collapsed into itself and swung about pivot hinge 40 flush, or near to flush, against the chassis 22 (as is shown in phantom lines in the right recess 32). The distal end 42 of the telescopic support post 34 will actually be under a portion of the chassis 22 when in this position, as shown by phantom lines in FIG. 2.

The strike-off tool system shown on the right side of the chassis in FIG. 2 is extended such that the support post 34 will brace the strike-off tool 36 against the force of fresh asphaltic material being spewed by the strike-off tool when the road widener is operational. When in this position hinge 44 is locked and will not swing open.

Additional insert section 46 can be inserted into the strike-off tool to add length. Because the support post 34 is pivotally attached to the chassis, its distal end will be able to be attached to the strike-off tool at connector 38 even if the length of the tool is modified, as would be the case, for example, if two extensions 46 were added.

A material guide 48 is set in an appropriate position, parallel to the movement of the widener, by an adjustable support 50. The guide 48 is known in the art and has sliding adjustable gate (not shown). The guide 48 is pivotally connected to the distal end of the tool 36 and could be swung flush against the tool when put in the stored position.

The pivot hinge 40 which connects the support post 34 to chassis 22 is fixedly attached to the chassis 22 within the tread width of the machine. This allows for the retraction of the support post 34 and pivoting against the chassis 22. The strike-off tool can be folded about hinge 44 and guide 48 can be collapsed against the tool such tha the strike-off tool system is substantially stored within the recess 32 of the chassis. The strike-off tool is attached to the chassis by way of hinge 52 which also provides for pivoting of the tool in its folded state into the recess as shown. It should be noted that on the preferred embodiment this hinge is outside the tread width of the widener.

A conveyor system is supported at the front of the chassis for delivering paving material evenly to the left side or the right side of the road widener as it proceeds forward. The conveyor system has hopper 54 fixedly attached to the chassis 22 and having sloped walls 56 for holding paving material (hot mix or cold mix) and funneling it upon conveyor belt 58 located underneath the hopper. The hopper is preferably about the same length as the width of the chassis and is capable of receiving and holding paving material deposited into it by a dump truck or other carrying means.

The conveyor belt is driven by two motors 60 and 62. The motors 60 and 62 drive the belt in one direction, for example towards the left of the widener, or in the opposite direction, towards the right side of the chassis 22. The belt rides upon upper rollers 59 and lower rollers 61.

The entire conveyor belt 58 and motors 60 and 62 are mounted on carriage 64 which rests on carriage rollers 66 such that the entire carriage can be rolled in a direction perpendicular to the direction of motion of the road widener. That is, the carriage and conveyor belt can be shifted to extend to the right of the chassis by a certain distance, preferably twenty inches, or the left by about twenty inches.

The conveyor carriage can be fixed in at least three different positions. The first is all the way to the left of the chassis with the belt protruding approximately twenty inches on the left and not protruding at all from the right. The second position is with both ends of the conveyor protruding evenly approximately ten inches each from both sides. This would be the preferred position of the conveyor for use during transport. A third position, where the conveyor extends approximately twenty inches to the right of the chassis, is used when the right side of the road widener is being paved.

A hydraulic cylinder 68 is connected at one end to the conveyor carriage and at the opposite end to the hopper or other structure that is fixedly supported by the chassis. Accordingly, operation of the hydraulic cylinder to increase or decrease its length (by causing the retraction or extension of rod 70) will act to shift the entire conveyor carriage and the conveyor resting thereon between the three positions mentioned above. Preferably the hydraulic cylinder has a twenty-inch stroke which would be capable of accomplishing the three positions.

The road widener may be operated in a variety of ways and is easily and quickly changed from one manner of operation to another. FIG. 1 shows the road widener oriented to pave the road on the left side, as distinguished from right side paving shown in FIG. 2. In FIG. 1 the chassis has strike-off tool 36 extended and supported by support post 34 on the left side of the chassis. The strike-off tool system on the right side is shown in the retracted position and the conveyor is extended to the left of the chassis in order to feed the paving material to the left side of the roadway in front of the strike-off tool. The operator's unit 28 with steering wheel 30 is moveable on guide 70 between a position on the right or the center of the chassis. It is shown in FIG. 1 to be on the left chasis and this would be the preferable position during paving operations on the left shoulder. When the right side strike-off tool system is retracted into the recess, a chain 72 from upper support 74 can be used to add additional support of the strike-off tool.

When paving the right side of the road, as shown in FIG. 2, the right side strike-off tool 36 is unfolded and extended fully about hinge 44 and is attached at connector 38 to support post 40. The left side support post 34 and strike-off tool 36, on the other hand, is folded and retracted into the left recess and is substantially within the recess. It does not add significant width to the road paving machine on that side of the machine.

Although FIG. 2 shows the conveyor evenly located in a middle position with equal parts extending from both the left and right side, normally when the right side of the roadway is being paved, the conveyor would be shifted to a position with the conveyor extending more to the right side. As previously mentioned, the position shown in FIG. 2 of the conveyor is that preferred for use during transport of the widener.

The road widener of the present invention is easily converted from being capable of paving on one side of the device to being capable of paving on the other. For example, the road widener shown in FIG. 1 would have its strike-off tool system on the left side retracted by disconnecting the support post 34 from strike-off tool 36, retracting the telescopic distal end 42, and pivoting the support post about pivot 40 such that the support post is parallel and adjacent to the recessed area of the chassis 22. The strike-off tool 36 is hydraulically retracted and swung about hinge 52 substantially within the recess 32. The conveyor is shifted from the position extending to the left of the machine to a position extending to the right of the machine. it is contemplated that this would be done by automatic operation of hydraulic cylinder 68 by activation of a switch near the operator's unit 28. The operator's unit 28 is slid on guide 70 from the left side to the right side.

The widener can be made capable for right side paving by pivoting out the strike-off tool 36 and extending it about hinge 44 to its full length and securing guide 48 by connector 50 to the appropriate angle. Support post 34 is then swung out approximately perpendicular to the chassis, extended to the appropriate length and connected to the strike-off tool at connector 38. The widener is now oriented to pave the opposite side of the roadway.

From the above description it will be apparent that there is provided an improved road widener with the advantages described above, but which obviously is susceptible to modification in its form, method, operation, detailed construction and arrangement without departing from the principles involved. It is to be understood that the invention is not limited to the specific features shown, but that the means, method and construction herein disclosed comprise the preferred form of several modes of putting the invention into effect. The invention is, therefore, claimed in any of its forms or modifications within the legitimate and valid scope of the appended claims.

What is claimed is:

1. A machine for widening a road, the machine comprising:

a self-propelled chassis supported on front and rear wheels, wherein the chassis contains a recessed area on each side within the tread width of said wheels;

two strike-off tool systems supported on the chassis, one set located on each side about the recess on that side, each tool system capable of being moved substantially into the recess, each tool system including a folding strike-off tool and a telescopic support post, the support post being pivotally supported from a hinge post attached to the chassis within the tread width of the wheel; and a conveyor supported near the front of the chassis, the conveyor capable of discharging paving material to either side of the chassis;

whereby the machine is capable of converting from paving on one side of the machine to another with two tool systems, and the tool systems are substantially within the machine width during transport.

2. The machine of claim 1 wherein the conveyor further comprises two motors, one near each end, and wherein the conveyor is capable of being driven in one direction by one motor and in an opposite direction by the other.

3. The machine of claim 1 wherein the conveyor can be shifted between a position extending from one side to a position extending from the other side of the machine.

4. The machine of claim 1 wherein the folding strike-off tool is pivotally supported from a point outside the recess and is hinged along its length such that the tool can fold back upon itself and into the recess.

5. The machine of claim 4 wherein one end of the telescopic support post is reversibly attachable to the strike-off tool.

6. The machine of claim 5 wherein the telescopic support post is capable of pivoting against the chassis, and the strike-off tool is capable of being positioned substantially within the recess.

7. The machine of claim 3 wherein the conveyor is slideably mounted on the chassis and is reversibly fixable in one of at least two positions.

8. The machine of claim 7 wherein the conveyor is mounted on rollers.

9. The machine of claim 7 further comprising means for shifting the conveyor between positions, the means for shifting being connected between the chassis and the conveyor.

10. The machine of claim 9 wherein the means for shifting is a hydraulic cylinder.

11. A road widening machine comprising:

a self-propelled chassis supported on front and rear wheels, wherein the chassis contains a recessed area on each side extending within the tread width of the wheels;

two strike-off tool systems supported on the chassis, each tool system having a telescopic support post pivotally attached at one end to the chassis at a hinge post within the recess, each tool system also having a strike-off tool pivotally attached to the chassis, the strike-off tool being capable of folding substantially into the recess, the support post reversibly attachable to the strike-off tool; and a conveyor system including a conveyor and a hopper, the hopper supported near the front of the chassis and the conveyor slideably mounted on the chassis below the hopper and reversibly fixable in position to feed one side or the other of the chassis with paving material introduced into the hopper, the conveyor system also having two motors, one mounted at each end of the conveyor and each capable of driving the conveyor in the opposite direction of the other, and means mounted to the chassis and to the conveyor for shifting the conveyor between positions;

whereby the machine is capable of converting from paving on one side of the machine to the other with two tool systems, and the tool systems are substantially within the machine width during transport.

12. The machine of claim 11, wherein the means for shiting the conveyor is a hydraulic cylinder.

13. The machine of claim 12 wherein the conveyor is mounted supported on rollers.

14. The machine of claim 11 wherein the conveyor can be reversibly adjusted to be in one of the positions selected from the group consisting of (a) extending from the right side of the chassis, (b) extending from the left side of the chassis, and (c) centered on the chassis.

15. The machine of claim 11 wherein the strike-off tools are longer than the recess.

* * * * *